United States Patent [19]

D'Agnolo

[11] Patent Number: 4,810,155

[45] Date of Patent: Mar. 7, 1989

[54] DEVICE TO CONVEY YARN PACKAGES

[75] Inventor: Armando D'Agnolo, Porcia, Italy

[73] Assignee: Matics Srl, Italy

[21] Appl. No.: 18,474

[22] Filed: Feb. 25, 1987

[30] Foreign Application Priority Data

Mar. 4, 1986 [IT] Italy ..... 83325 A/86

[51] Int. Cl.[4] ..... B65G 1/06

[52] U.S. Cl. ..... 414/331; 198/369; 198/487.1; 242/35.5 A; 414/398; 414/399; 414/401; 414/911

[58] Field of Search ..... 414/331, 389, 345, 347, 414/398–401, 502–505, 911, 277–283; 198/803.12, 487.1, 369, 586; 242/35.5 A

[56] References Cited

U.S. PATENT DOCUMENTS

| | | | |
|---|---|---|---|
| 1,916,531 | 7/1933 | Robb | 414/398 X |
| 2,360,146 | 10/1944 | Lima | 414/398 X |
| 2,761,578 | 9/1956 | Brownlee et al. | 414/505 X |
| 3,613,911 | 10/1971 | Walchuter | 414/331 |
| 3,637,095 | 1/1972 | Kampfer | 414/331 |
| 4,153,211 | 5/1979 | Lenk et al. | 242/35.5 A |
| 4,379,671 | 4/1983 | Cochran | 414/331 |
| 4,555,215 | 11/1985 | Raasch et al. | 414/331 X |
| 4,600,351 | 7/1986 | Nelson | 414/331 |
| 4,669,047 | 5/1987 | Chucta | 414/331 X |
| 4,669,942 | 6/1987 | Nagasawa | 414/331 |
| 4,674,940 | 6/1987 | Uehicla et al. | 414/400 |
| 4,729,709 | 3/1988 | Raasch | 414/399 |

FOREIGN PATENT DOCUMENTS

| | | | |
|---|---|---|---|
| 390309 | 4/1922 | Fed. Rep. of Germany | 198/369 |
| 2347926 | 4/1975 | Fed. Rep. of Germany . | |
| 207087 | 2/1984 | Fed. Rep. of Germany | 414/398 |
| 3244925 | 6/1984 | Fed. Rep. of Germany . | |
| 2405020 | 6/1979 | France | 414/331 |

*Primary Examiner*—Frank E. Werner
*Assistant Examiner*—David A. Bucci
*Attorney, Agent, or Firm*—Wegner & Bretschneider

[57] ABSTRACT

Device (10) to convey yarn packages which is suitable to take the yarn packages from a supply machine such as a winding machine, open-end spinning machine, two-for-one twisting machine, take-up frame for manmade filaments, fly frame, finishing machine, etc., the yarn packages being taken substantially at the outlet of the supply machine and then being delivered to transient storage containers, which may consist of creels, support shafts, dyehouse chests, cases, cartons, pallets, etc., the device comprising in functional relationship on a main frame (15):

a substantially horizontal conveyor (16) extending lengthwise at an angle to the lengthwise axis of a machine (11) which produces yarn packages (23), and cooperating with an outlet (11) for yarn packages of the machine (11), a transfer system (17), an elevator (18) lying and being orientable on a vertical plane, and a delivery head (19) suitably prepared for individual tasks, the main frame (15) being movable at an angle to the lengthwise axis of the yarn package producer machine (11).

13 Claims, 5 Drawing Sheets

DEVICE TO CONVEY YARN PACKAGES

Figure 1:
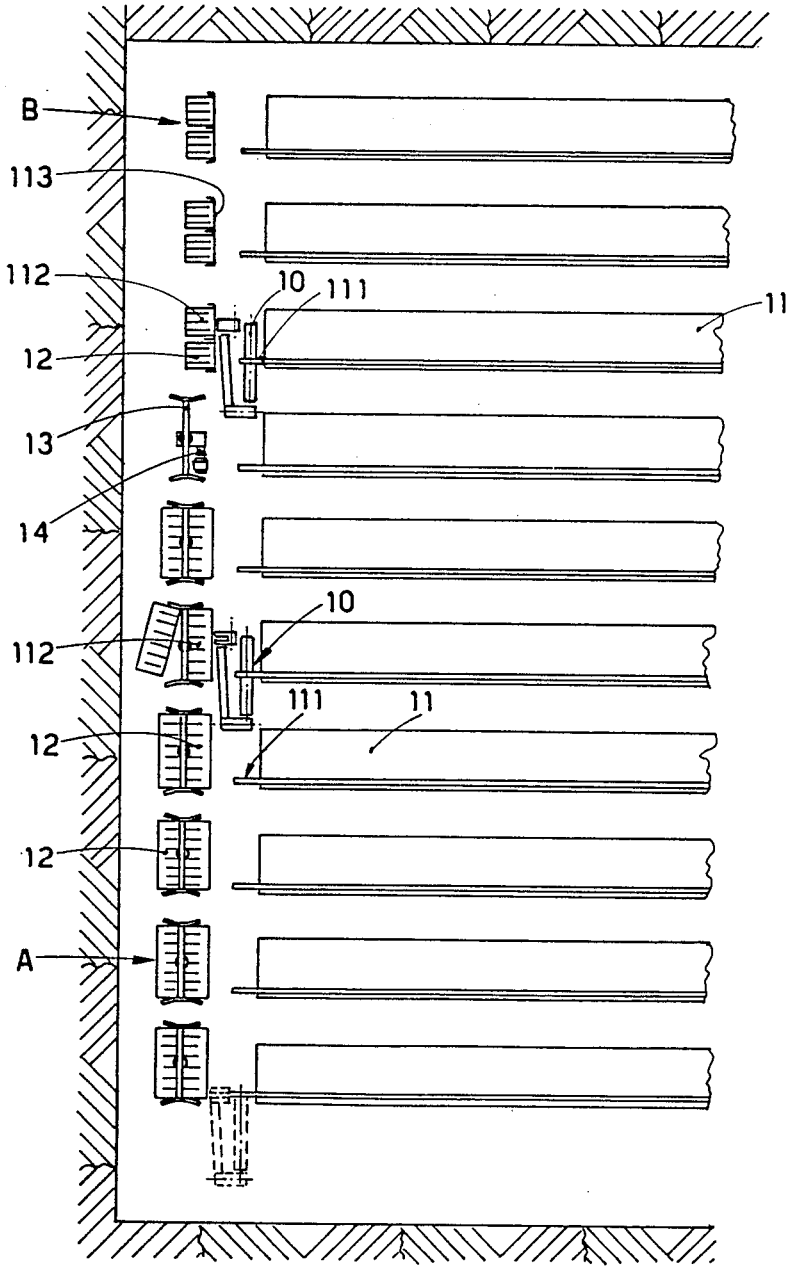

This invention concerns a device to convey yarn packages which is suitable for installation downstream of machines which produce yarn packages, such as winding machines, fly frames,high draft finishing machines, open-end spinning machines, two-for-one twisting machines, take-up frames for manmade filament and flanged bobbin winders.

Such yarn packages may consist of continuous filament yarns such as manmade filaments or of yarns of discontinuous fibres such as wool, cotton, etc.

To be more exact, this invention concerns a device able to take from a yarn package producer machine the yarn packages produced thereon and to load such yarn packages in an orderly manner on a transient storage container.

The words "yarn packages" are used here as a generic term to indicate any type of package of wound yarn or roving, such as reels, cops and cylindrical or truncated-cone packages in general since the invention is suitable for all applications like those cited above.

It is known that yarn packages in the textile industry are transferred by means of creels, support shafts, box-type containers, pallets, etc.

The yarn packages are withdrawn from their producer machines and stored momentarily on such supports either by hand or with the use of robots, which take one or more yarn packages at a time and deliver them to their provisional support.

The problems linked to withdrawal and delivery operations performed by hand are known owing to their burdensome nature and the costs involved.

DE No. 3.244.925 provides a robotised device which moves to-and-fro to take one or more yarn packages at at time and to deliver them to the pins of a creel.

The robot has to perform all the movements and positionings on each occasion and therefore requires relatively long working times. Moreover, such robotised device entails structural usage limits since creels which are too long or too high cause downtimes too long to permit the use of such a device.

Furthermore, the reciprocal positioning of the producer machine, robotised device and creel or transient support or momentary store has to be very accurate, for otherwise the whole assemblage does not work.

Besides, the robotised device requires the employment of complex systems for programming, control and linking and therefore entails high costs of setting up, working and maintenance.

DE No. 2.347.926 discloses a mechanical device which can be applied specifically to cops but which causes problems since it cannot be applied to tapered bobbins or bobbins in themselves and since it comprises specific special equipment depending on its specific application; moreover, it entails downtimes for taking and positioning the yarn packages since it has to be positioned vertically and transversely on each occasion.

Such embodiments cause anomalous and unnatural movements, including always a substantially unproductive return movement which entails downtimes.

It is also known that there is a problem in engaging the inside or outside of the yarn package with devices of the above type. Such engagement requires appropriate engagement means and relative actuators and also control means.

The present applicant has therefore studied the problem as a whole and proposed a plurality of objectives with resulting advantages.

Some of the objectives undertaken by the applicant are as follows:

the creation of a speedy device which reduces to a minimum the downtimes caused by the positioning and finding of a yarn package to be loaded or of the place where the yarn package is to be positioned;

the maximization of usage of all the space available and the minimization of movements;

the ability to supply creels and, more generally, momentary storage points of widely varying sizes, even of very long and/or high dimensions, and also to supply several creels or momentary storage points per machine, thus arranging for at least one additional reserve creel or momentary storage point or transient support for yarn packages;

the ability to eliminate complicated structures for data storage, control and programming together with a resulting simplication of construciton, running and maintenance;

the embodying of a compact device of a small overall bulk which at the same time is capable of a wide flexibility of operation;

the ability to check the yarn package before storage;

the ability to carry out auxiliary work on the yarn package before storage;

the ability to combine two yarn packages to feed two-for-one twisting machines;

the ability to find quickly and easily the seating where the yarn package is to be placed.

These and other objectives and relative advantages together with further advantages will be made clear hereinafter.

According to the invention the device, by being individually adapted beforehand, can supply equally well either creels, or supports or equipment bearing stationary shafts, or else dyehouse chests, or cases or cartons, or pallets, etc.

The invention arranges to transfer the yarn packages from the machine to a momentary store by means of a coordinated conveyor system using straps, belts, chains or equivalents thereof. This system takes the yarn packages at the outlet of the supplying machine and delivers them, properly positioned and oriented, directly to a transient storage point, where the yarn packages themselves are set in order according to a suitable lay-out, possibly after having them checked and/or treated and/or combined in pairs in an intermediate position.

In a simplified embodiment a conveyor is provided down-stream of the producing machine, receives the yarn packages produced and delivers them to an intermediate transfer system, which in turn consigns them to an elevator, which by employing a delivery head moves the yarn package to a transient storage element and positions it.

To make the device suitable and to adapt it, according to the invention, to the specific transient storage element employed, action is taken on the delivery head to prepare it for its function. Such delivery head may be suitable to transfer the yarn packages or to engage and deliver them or else to engage and discharge them and will be characterized by the transient storage element.

We shall deal hereinafter specifically with a system for supply of yarn packages to transient storage elements of a creel type with pins, such creels being kept substantially stationary while being loaded and being able to accommodate one or more yarn packages per pin.

This example,which in fact concerns the delivery head alone since the remainder of the device will be structurally the same even with variations of the transient storage elements, has been adopted to simplify the description.

The devices to convey yarn packages according to the invention may be installed at the head or tail of yarn package producer machines, which are equipped with known means to discharge the yarn packages.

The devices according to the invention are in any event located on the discharge side of the machine and are able to serve one or more machines.

In the event that the devices of the invention are kept substantially stationary at one machine but are arranged to serve several machines which, for instance, are processing the same yarn, a momentarily positionable chute may be provided, or else a transfer means which also is momentarily positionable and able to supply to the device itself the yarn packages produced by another machine may be provided.

Moreover, the invention enables several temporary, transient storage elements to be fed which are positioned in series, one after another, and which are supplied in sequence as required, depending on the usage requirements, as in the case of several machines working with different qualities of packaged material or in the event of one single machine working with at least two different qualities of material.

The device according to the invention may also load the transient storage elements sideways, the storage elements being positioned with their lengthwise axis parallel to the lengthwise axis of the producer machines; the device will load such transient storage elements on its right or left.

Thus, it is possible to supply one or more transient storage elements located, for instance, on the left and, when these are completed, to supply yarn packages to transient storage elements located on the right.

According to the invention the yarn packages may be arranged in columns or in lines, that is to say, the device can move to complete successive columns of yarn packages in the various compartments or can complete rows of compartments. The device may also load on transient storage element first and thereafter another one.

A cycle may possibly be arranged in which one transient storage element is completed and replaced with another neighboring storage element. Cycles may also be established in which several transient storage elements are loaded alternately, with the device loading one or the other, for instance, according to the type of yarn package momentarily conveyed.

The device of the invention can also work to discharge the yarn packages stored in the transient storage elements.

These and other capabilities are proper to the device according to the invention.

According to the invention the device comprises a conveyor which extends lengthwise in a suitable manner and receives yarn packages from a producer machine; this conveyor has a substantially horizontal development and is secured to a frame which is advantageously able to move at a right angle to the lengthwise axis of the machine producing the yarn packages.

A transfer system is comprised at the end of the conveyor and may be equipped, in one of its advanced embodiments, either to monitor the yarn packages optically, or possibly to tilt or orient them, or to treat them by batching or in other ways, or else to combine a pair of yarn packages.

The transfer system is positioned advantageously at an angle to the conveyor so as to save space and make the device compact; the transfer system too is solidly fixed to the movable frame.

The transfer system delivers the yarn packages to an elevator placed advantageously parallel to the conveyor and provided with a controlled orientation movement lying substantially on a vertical plane. The axis of orientation lies in the neighbourhood of the transfer system.

The terminal portion of the elevator farthest from the transfer system can cover an extent vertically from a point near the floor to at least the highest point of the temporary or transient storage element.

According to the invention the elevator, when being oriented vertically, can move its terminal portion substantially along an arc of a circle or substantially according to a linear development substantially normal to the ground.

At its terminal portion farthest from the transfer system the elevator comprises an individualized delivery head to consign and position correctly the yarn packages in the transient storage element.

According to a particularized embodiment, where creels are being employed as temporary storage elements, the delivery head is equipped with slider rollers.

The invention is therefore embodied with a device to convey yarn packages which is suitable to take the yarn packages from a supply machine such as a winding machine, open-end spinning machine, two-for-one twisting machine, take-up frame for manmade filaments, fly frame, finishing machine, etc., the yarn packages being taken substantially at the outlet of the supply machine and then being delivered to transient storage containers, which may consist of creels, supports shafts, dyehouse chests, cases, cartons, pallets, etc., the device comprising in functional relationship on a main frame:

a substantially horizontal conveyor extending lengthwise at an angle to the lengthwise axis of a machine which produces yarn packages,and cooperating with an outlet for yarn packages of the machine, a transfer system, an elevator lying and being oriented on a vertical plane, and a delivery head suitably prepared for individual tasks, the main frame being movable at an angle to the lengthwise axis of the yarn package producer machine.

Figure 2A:
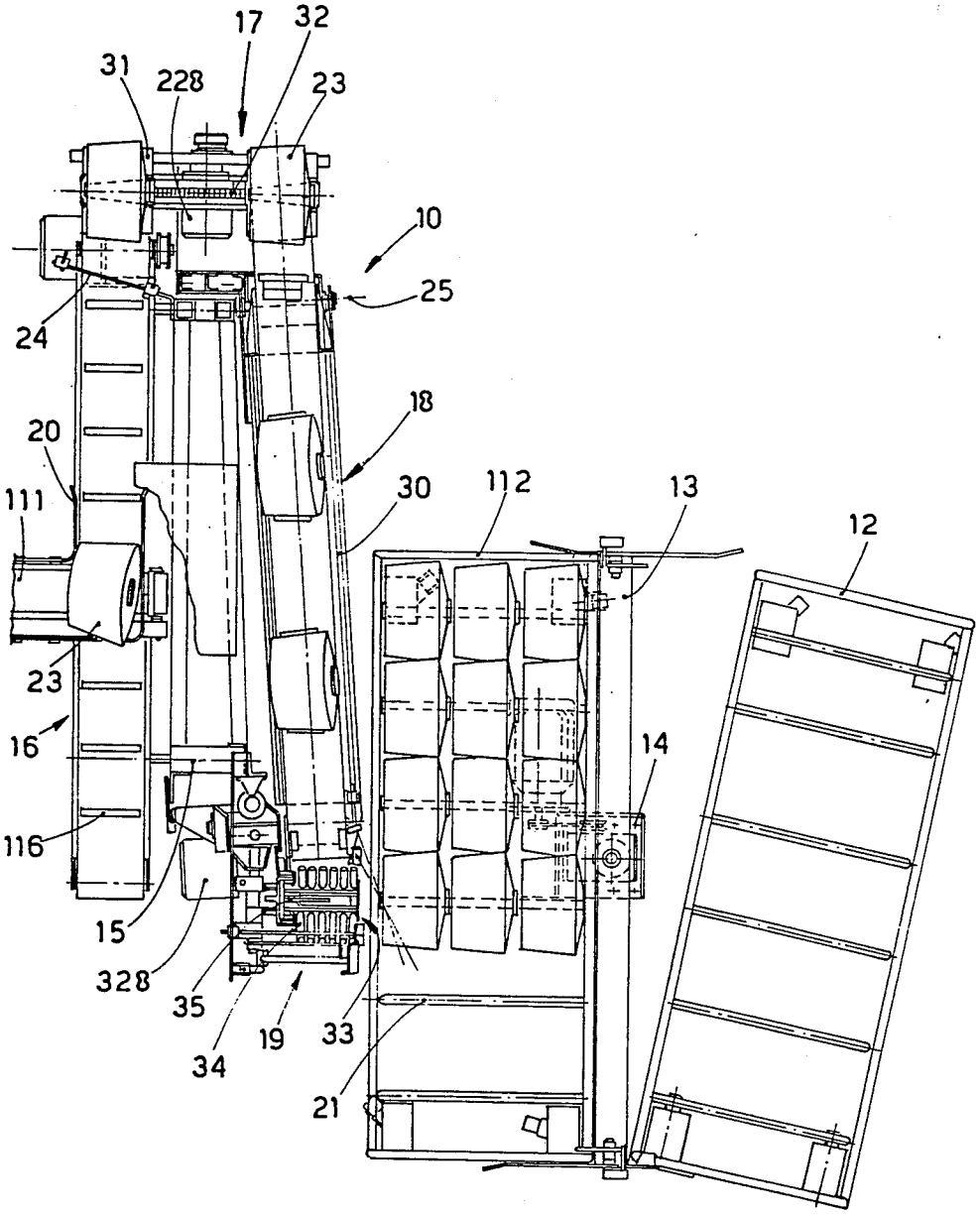
Figure 2B:
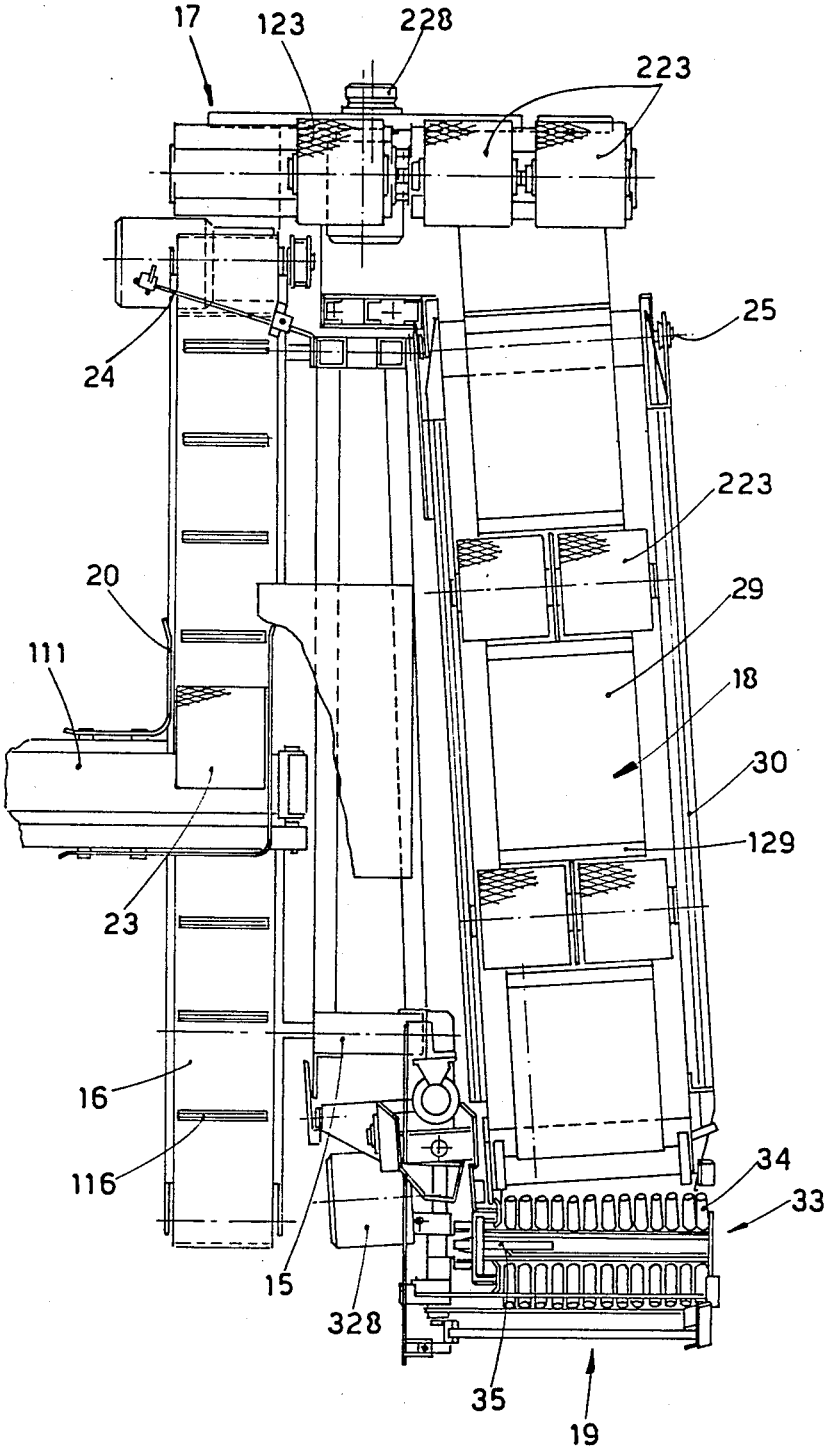
Figure 3:
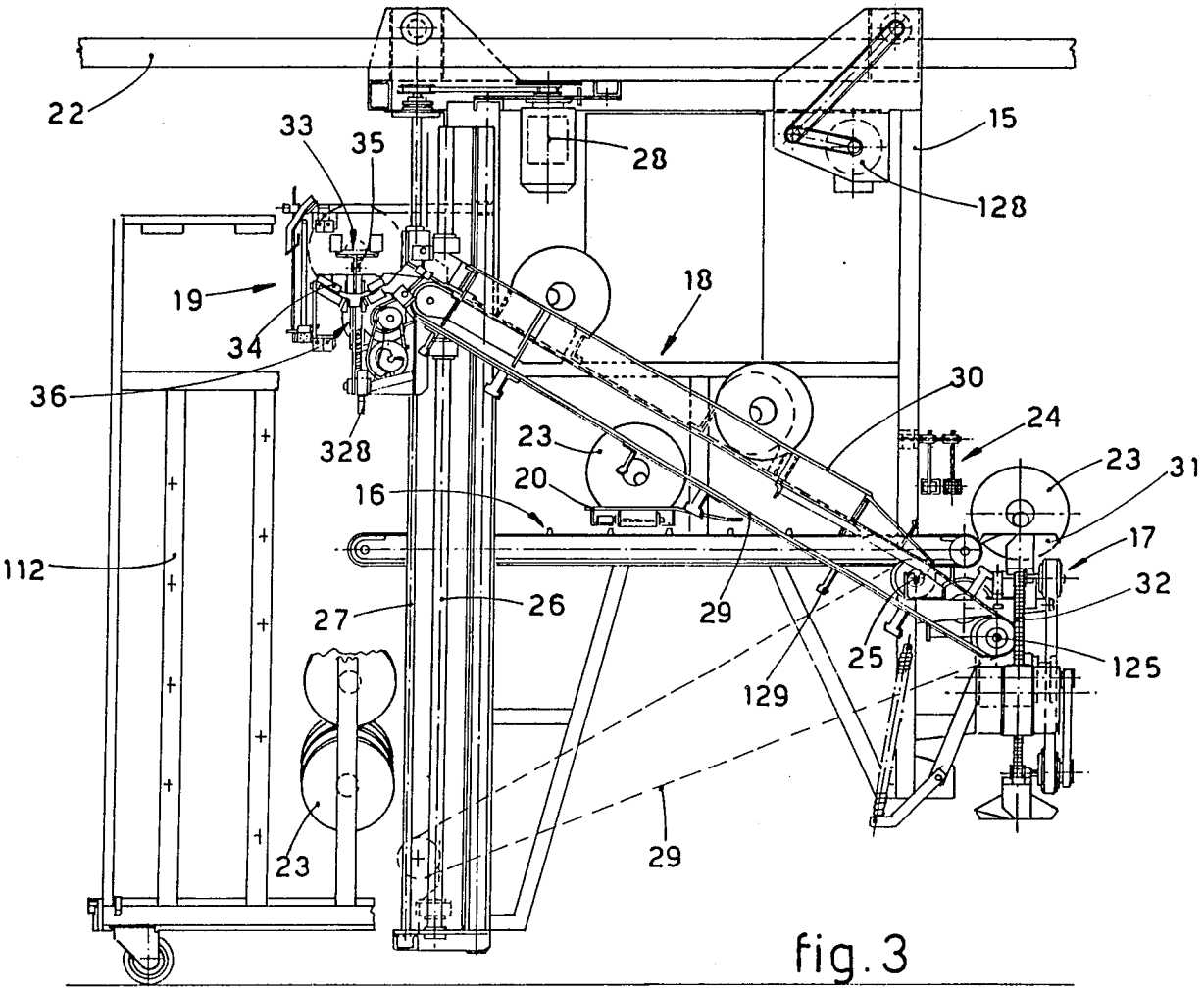
Figure 4:
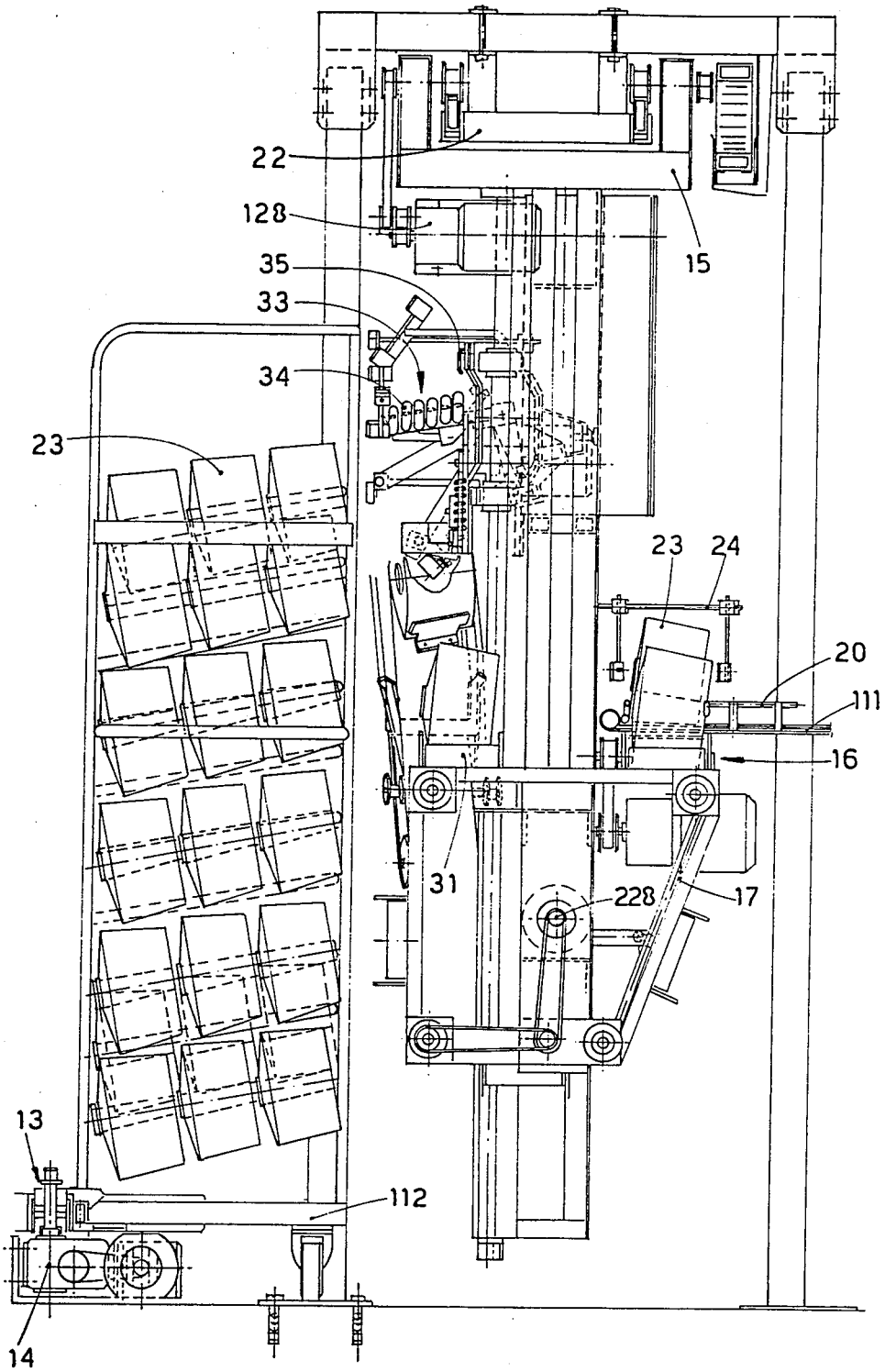

Let us now see a preferred embodiment of the invention with the help of the attached figures, which form an integral part of the description but are given as a non-restrictive example. The figures show the following:

FIG.1 gives a view from above of a plant which employs a device according to the invention with two types of transient storage elements;

FIG. 2*a* gives a plan view of a device according to the invention;

FIG. 2*b* shows a veriant of FIG. 2*a* suitable for combining a pair of yarn packages;

FIG. 3 gives a front view of the device of FIG. 2;

FIG. 4 gives a side view of the device of FIG. 2.

FIG. 1 gives a plan view of a plant employing a device according to the invention. In this example the device can serve two creels positioned back to back (case A) or side-by-side (case B).

In the figure a conveyor device 10 according to the invention is located immediately downstream of, and cooperates with, an outlet 111 for yarn packages of a yarn package producer machine 11, which is shown diagrammatically and can be of any required type.

Such outlet 111 may be stationary or be capable of being tilted at its side or at its top so as to eliminate its protrusion outside the shape of the machine 11 at least momentarily.

The conveyor device 10 cooperates with a wheeled creel 12, which in this case is coupled, back to back or side-by-side, to another creel by a positioner framework 13.

This positioner framework 13 may be stationary 113 where the creels 12 are paired side-by-side (case B), or may be able to rotate where the creels 12 are paired back to back (case A); if the framework 13 is rotary, it will be driven advantageously by a rotation unit 14, but if it is stationary, the creels 12 may be withdrawn at their rear (case B).

In the event of the positioner framework 13 being able to rotate (case A), when the creel 112 being loaded has been filled, the rotation unit 14 sets the positioner framework 13 in rotation and, in cooperation with the conveyor device 10, positions the empty creel 12 present behind the creel being loaded 112 so that the latter 112 can be replaced with an empty creel. Suitable means for temporary connection are included.

In the event of the creels 12 being paired side-by-side (case B), when one creel has been filled, the conveyor device 10 passes to the other creel 12, while the full creel 112 is replaced at the rear of the positioner framework 113.

The conveyor device 10 comprises a main frame 15 which can be suspended on, and guided by, overhead runways 22 (as in the example shown) or may be guided by roller conveyors on the floor or by lateral runways.

A motor 128 drives the main frame 15 in the working and to-and-fro movements of the latter.

A substantially horizontal conveyor 16 is positioned on the main frame 15 and is long enough for the device 10 to be able to move along the whole front of the creel 112 being loaded.

This feature is important because in this way the movements of a delivery head 19 are reduced to a minimum and the conveyor 16 is always connected to the yarn package outlet 111.

The conveyor 16 cooperates with and receives yarn packages 23 from the machine outlet 111, which may be equipped with yarn package guides 20 to deliver the yarn packages 23 correctly to the conveyor 16.

One or more sensors to detect the presence of yarn packages may be provided in cooperation with the guides 20 and may possibly control coordinated discharge means.

The conveyor 16 may comprise crosswise ridges 116 to facilitate the conveying of the yarn packages 23.

The conveyor 16 may be a belt conveyor (as in the figures) or may employ straps, chains, rollers, etc.

The conveyor 16 consigns the yarn packages 23 to a transfer system 17, which in this case has a feed axis positioned at an angle of about 90° to the feed axis of the conveyor 16.

The transfer system 17 may be adapted individually to perform manifold tasks, as we shall see later; it moves forward step-by-step, whereas the conveyor 16 can move forward continuously.

The feed of the conveyor 16 is conditioned by control means 24 which detect the arrival of a yarn package 23. These control means 24 are connected to sensors which reveal the presence of a yarn package 23 in the loading station of the transfer system 17, and also to sensors which reveal forward movement of the transfer system 17.

The result of this is that with the arrival of a yarn package 23 in cooperation with the control means 24, if there is a yarn package 23 already in the loading station of the transfer system 17 or if the transfer system 17 is moving, the control means 24 halt the movement of the conveyor 16.

The transfer system 17 consigns the yarn package 23 to an elevator 18, which moves forward continuously on an axis of feed lying on a vertical plane approximately parallel to the vertical plane containing the axis of feed of the conveyor 16.

The elevator 18 conditions the delivery of yarn packages 23 from the transfer system 17 and therefore conditions the step-by-step advance of the transfer system 17.

The elevator 18 can move vertically with its axis of rotation or orientation at 25, a tensioner roller 125 being comprised which can tighten the elevator belt during orientation.

The vertical movement of the elevator 18 is controlled by guides 26 and by a threaded drive shaft 27 actuated by a motor 28.

The elevator 18 comprises at its end a specialized delivery head 19, which in the example shown is specialized for the delivery of yarn packages to pins 21 of the creel 112 being loaded.

The delivery head 19 is able to move along at least the whole height of the creel 112, whereas the main frame 15 is able to move along the whole length of the creel 112 being loaded or of the empty creel 12 and creel 112 being loaded.

If so required, the elevator 18 can be extended (and will comprise suitable belt tightening means) so that the delivery head can move lengthwise along at least part of the creel 112 being loaded, the main frame 15 being momentarily stationary.

To assist transfer of the yarn packages 23 from the transfer system 17 to the elevator 18, the latter 18 may comprise a fixed point 25 which imposes on the movable carrier 29 of the elevator 18 a suitable and substantially constant geometry in the area that receives the yarn packages 23.

The movable carrier 29 may consist of a belt, straps, chains, etc. and will comprise crosswise ridges 129 able to engage the yarn packages 23 securely, even during very steep ascent or descent.

The elevator 18 may include lateral railings 30 to retain the yarn packages 23 laterally and is driven by a motor 328.

According to the invention the orientable length of the elevator 13 may stay constant during vertical orientation or may vary, depending on the angular position of orientation.

The transfer system 17 is driven step-by-step by a motor 228 which acts on a transfer carrier 32, which may consist of a belt or belts, chains, threaded shafts, etc. that bear containers 31 spaced apart. Such containers 31 may be solidly fixed to the transfer carrier 32, or may be movable independently, or may be capable of being tilted or opened at least at one side so as to receive and/or consign the yarn packages as required.

The transfer system 17 may be equipped with means to monitor the yarn packages 23, such as a telecamera connected to a remote-control station which may discharge yarn packages 23. It may also be equipped with means to apply markings and labels.

In a variant the transfer system 17 may also be equipped with rotation apparatus, for instance a rack and toothed wheel which mesh momentarily to overturn the yarn packages 23 when necessary.

Moreover, in a variant the transfer system 17 may be provided with means for treatment of yarn packages, so that, while the latter 23 pass from their point of discharge from the conveyor 16 to their point of consignment onto the elevator 18, they may be checked, marked, labelled, overturned if necessary and treated.

Such treatment means may be spray means,brush means, shower means or means of another type suitable for the purpose.

A further variant of the transfer system 17 will be applicable to the case of yarn packages intended to feed two-for-one twisting machines and will receive two yarn packages 123 in programmed sequence, pair them axially 223 and transfer them to the elevator 13 (FIG. 2*b*).

Axial pairing of the yarn packages 123 may be carried out with the help of jacks or levers, which have not been shown in the figure so as to simplify it.

The device 10 according to the invention can serve a plurality of machines 11.

In the event of a device 10 being able to deliver yarn packages 23 or paired yarn packages 223 to a creel 12, the delivery head 19 may comprise a cradle 33 consisting of a plurality of rollers 34 that assist axial discharge of a yarn package 23 without the surface of the package being damaged.

A thruster 35 facilitates discharge of the yarn package 23 or paired packages 223 from the cradle 33. The cradle 33 may be supported by an element 36 which positions and orients the axis of delivery of the yarn packages 23.

Alignment of the delivery head 19 may be performed by employment of photoelectric cells or proximity sensors or another means able to detect the creel pins 21 or the presence of enough yarn packages on the pins 21.

The delivery head 19 may be solidly fixed to the elevator 18 or may be able to move in relation thereto.

I claim:

1. A device to convey yarn packages from an outlet of a supply machine, having a longitudinal axis, producing yarn packages to transient storage containers, the device comprising:

(A) a main frame, mounted on guides and movable on said guides, by means of a motor, in a direction forming an angle with respect to the longitudinal axis of said supply machine;

(B) a substantially horizontal belt conveyor carried by said main frame and at an angle with respect to the longitudinal axis of the supply machine;

(C) a belt transfer system carried by said main frame;

(D) a belt elevator carried by said main frame and whose longitudinal axis lies on a vertical plane, said belt elevator having at least one segment pivotable in said vertical plane;

(E) a delivery head disposed at one end of said belt elevator, said head being suitably prepared for individual tasks; said yarn packages being deposited from said outlet, onto said belt conveyor, then carried by said belt conveyor to said belt transfer system, then transferred onto said belt elevator, then carried by said belt elevator, then deposited in proximity of said delivery head, and finally delivered by said head onto said transient storage containers.

2. Device as claimed in claim 1, in which the conveyor cooperates with yarn package guides included at the outlet for yarn packages of the machine, the conveyor (16) being able to move in relation to such guides (20) and cooperating therewith substantially along its whole length.

3. Device as claimed in claim 1, in which the lengthwise length of the conveyor is able to serve at least the whole of one dimension of a transient storage container.

4. Device as claimed in claim 1, in which the transfer system is able to move forward step-by-step.

5. Device as claimed in claim 1, in which the transfer system has its lengthwise axis lying on a plane substantially parallel to the plane containing the lengthwise axis of the conveyor.

6. Device as claimed in claim 1, in which the transfer system has its lengthwise axis lying on a plane positioned at an angle to the vertical plane containing the lengthwise axis of the conveyor.

7. Device as claimed in claim 1, in which the elevator is orientable on a vertical plane substantially parallel to the vertical plane which contains the conveyor lengthwise.

8. Device as claimed in claim 1, in which the elevator comprises at its end the delivery head able to move on a vertical plane with the elevator.

9. Device as claimed in claim 1, in which the terminal portion of the outlet for yarn packages of the machine is capable of being positioned momentarily within the exterior outline of the machine.

10. Device as claimed in claim 1, in which the length of the orientable segment of the elevator is constant.

11. Device as claimed in claim 1, in which the feeds of the conveyor and elevator are consequent and continuous in the same direction.

12. Device as claimed in claim 1, in which the feeds of the conveyor and elevator are consequent and continuous but move in opposite directions (parallel and side-by-side).

13. Device as claimed in claim 1, in which a thruster cooperates with the delivery head in discharging and delivering the yarn packages.

* * * * *